United States Patent [19]

Nani

[11] 4,197,720

[45] Apr. 15, 1980

[54] TWO-PART BAND STRUCTURE WITH INTERENGAGEABLE ENDS

[76] Inventor: James Nani, 18242 John R. St., Detroit, Mich. 48203

[21] Appl. No.: 887,441

[22] Filed: Mar. 16, 1978

[51] Int. Cl.[2] ..... A44C 5/12

[52] U.S. Cl. ..... 63/11; 63/3

[58] Field of Search ..... 63/3, 10, 11, 6, DIG. 3, 63/15.7, 2, 7, 8, 9, 4; D11/3, 5

[56] References Cited

U.S. PATENT DOCUMENTS

| | | | |
|---|---|---|---|
| 401,746 | 4/1889 | Johnstone | 63/11 X |
| 2,031,110 | 2/1936 | King | 63/3 |
| 2,775,093 | 12/1956 | Kundert | 63/4 |
| 2,778,547 | 1/1957 | Atterby | 63/DIG. 3 |
| 3,619,913 | 11/1971 | Albrecht | 63/15.7 |

FOREIGN PATENT DOCUMENTS

| | | | |
|---|---|---|---|
| 1184417 | 2/1959 | France | 63/DIG. 3 |
| 859188 | 1/1961 | United Kingdom | 63/DIG. 3 |

*Primary Examiner*—F. Barry Shay

*Attorney, Agent, or Firm*—Benjamin W. Colman

[57] ABSTRACT

A pair of readily separable and conjoinable band or bracelet members, provided with complementary integrally formed end fittings, snap together to form a unitary bracelet. At least one of the band members is reversible with respect to the other member. The end fittings of one member interengage with complementary end fittings of the other member. The two members may be generally arcuate in design.

14 Claims, 21 Drawing Figures

TWO-PART BAND STRUCTURE WITH INTERENGAGEABLE ENDS

BRIEF SUMMARY OF THE INVENTION

The invention involves a two-piece readily conjoinable and separable band or bracelet structure. Each piece or band member is generally in strip form and provided with protrusions or end fittings integrally formed in the member to complementarily interengage with protrusions or end fittings on the other member. These complementary end fittings may be of substantially the same general configuration or different.

The band members have fittings, adjacent their distal ends, which include partially spherical laterally outwardly extending or directed protrusions convexly formed on the outwardly facing side and concavely formed on the other side, annular laterally outwardly extending or directed protrusions embodying both convex and concave features on the same side and reverse features on the other side, truncated partially spherical laterally outwardly extending or directed protrusions convexly formed on the outwardly facing side, or openings for the insertion therethrough of partially spherical or truncated laterally outwardly extending or directed protrusions.

The band members comprise a single or plural segments in generally strip form, and are preferably made of metal or plastic materials. If in metal, the preferred method of fabrication is by conventional stamping operations, and if in plastic, the members are preferably molded. The band members can be arcuate in configuration or design, or they may be of oval, square, or other desirable shape.

DETAILED DESCRIPTION

As shown in the several views of the drawings, common features of the preferred embodiments of the invention include a pair of band members in generally strip or modified strip form, at least one protrusion in partially spherical or truncated spherical form on one band member, and at least a nesting or mating complementary fitting of one band member for the end fitting of the second band member.

Figure 1:
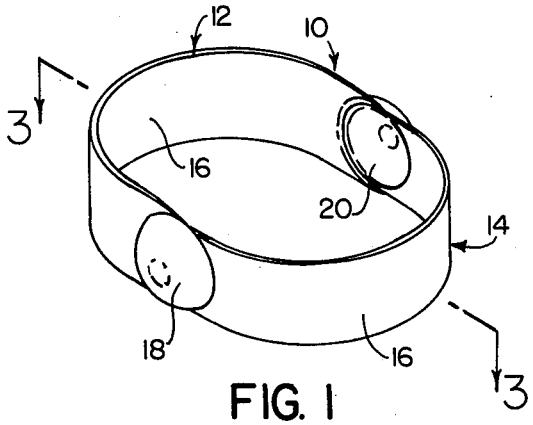
FIG. 1 is a perspective view of a preferred embodiment of the invention of a bracelet structure, in assembled form.
Figure 2:
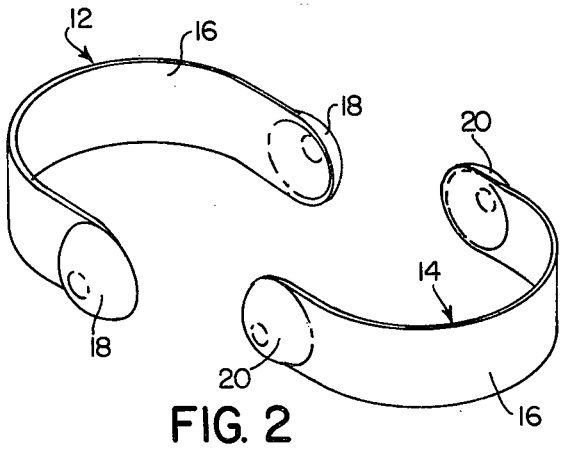
FIG. 2 is a perspective view of the embodiment illustrated in FIG. 1 showing the band members separated from each other, i.e., in disassembled attitude.
Figure 3:
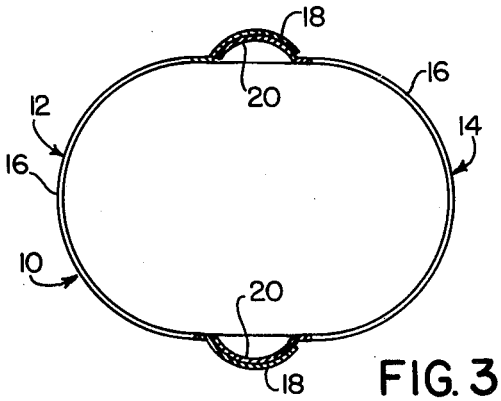
FIG. 3 is a horizontal sectional view, partially in elevation, taken substantially on the line 3—3 of FIG. 1.

A basically simple band or bracelet structure 10 is shown in FIGS. 1, 2 and 3, wherein the band members 12 and 14 each comprises a strip body or web portion 16 and fittings in the form of partially spherical protrusions or projections 18 and 20, somewhat in the form of a convexo-concavo nipple. The protrusions 18 and 20 can be hemi-spherical, or less than, or more than hemispherical, i.e., the hemispherical portion may be extended upon a cylindrical portion projecting from the strip body. The protrusions 18 and 20 comprise the complementary end fittings of each band member 12 and 14 respectively. The protrusions 18 are of slightly larger dimensions than those of the complementary protrusions 20 that seat or nest closely within them as illustrated in FIGS. 1 and 3.

Figure 3A:
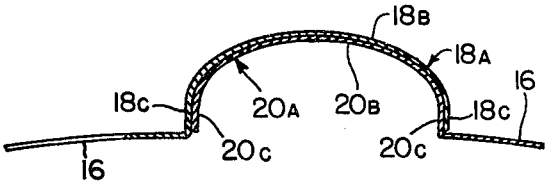
FIG. 3A is a fragmentary horizontal sectional view similar to that shown in FIG. 3, showing a slight modification of the protrusions that interengage at the distal ends of the bracelet band members.

As shown particularly in FIG. 3A, the protrusions 18A and 20A comprise the partially spherical crown portions 18B and 20B respectively and the cylindrical portions 18C and 20C respectively therebelow and formed integrally therewith.

Of course, it will be understood by those skilled in the art to which the invention pertains that the configurations of the protrusions 18, 20, 18A, 20A, 18B, 20B, 18C and 20C, disclosed herein, may be modified to other forms such as squares, rectangles, ovals, and combinations thereof without departing from the spirit or essence of the invention. The term "protrusions" is not limited to the forms disclosed but used herein to describe any of such forms of projection.

Figure 4:
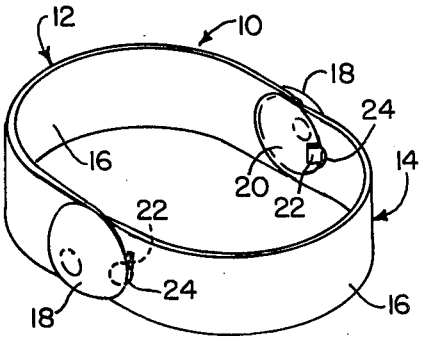
FIGS. 4 and 5 are perspective views corresponding to those shown in FIGS. 1 and 2 respectively of a slightly modified form of the bracelet structure embodiment.
Figure 5:
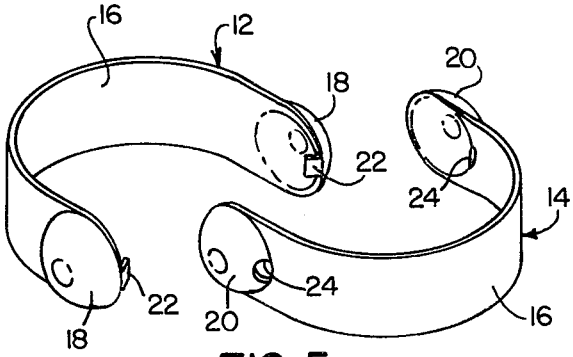

A slightly modified version of the band or bracelet structure 10 is illustrated in FIGS. 4 and 5, wherein return-bent hooks 22 are integrally formed in and extend from the protrusions 18 on the band member 12. In the complementary band member 14, openings 24 are provided through the protrusions 20 to receive the return-bent hooks 22 of the member 12. Upon interengagement, as shown in FIG. 4, the hooks provide a more positive locking of the band members.

Figure 6:
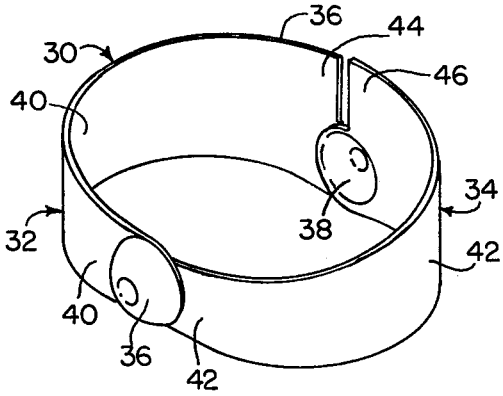
FIGS. 6 and 7 are perspective views of a modified form of a bracelet structure, in assembled form, corresponding generally to that shown in FIG. 1.
Figure 7:
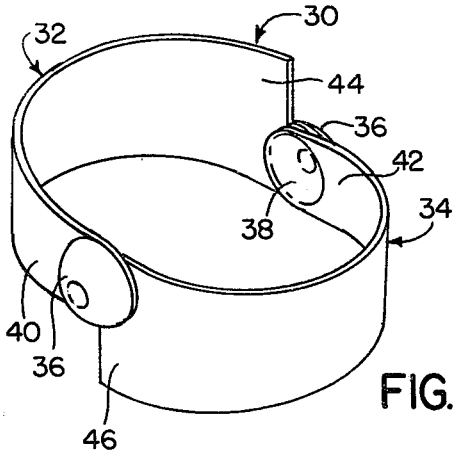

A reversible form of bracelet structure is shown in FIGS. 6 and 7. Here, the bracelet structure 30 comprises a pair of strip-form band memers 32, 34 having protrusions 36 and 38 respectively at the distal ends of their body or web portions 40, 42 respectively. The band members 32 and 34 are narrower in width at one end adjacent the protrusions and wider at their other ends. The tapering form of these members is clearly illustrated in FIG. 6, where the smaller ends 40, 42 of members 32 and 34 respectively are interengaged at the front of the structure 30 and their wider ends 44,46 are interengaged at the back. Reversing the interengagement of the band members 32 and 34 at protrustions 36 and 38 brings the wider end 46 of band member 34 into juxtaposition with the narrow end 40 of the band member 32, and the wider end 44 of member 32 into juxtaposition with the narrow end 42 of member 34, as shown in FIG. 7.

Figure 8:
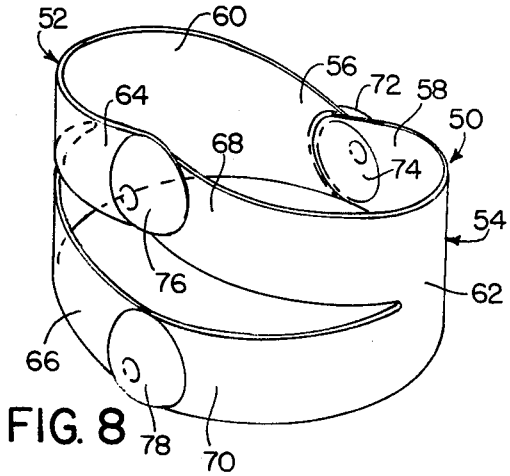
FIGS. 8 and 9 are perspective views of another modified form of a bracelet structure embodying the invention, showing the structure in assembled and disassembled attitudes respectively.
Figure 9:
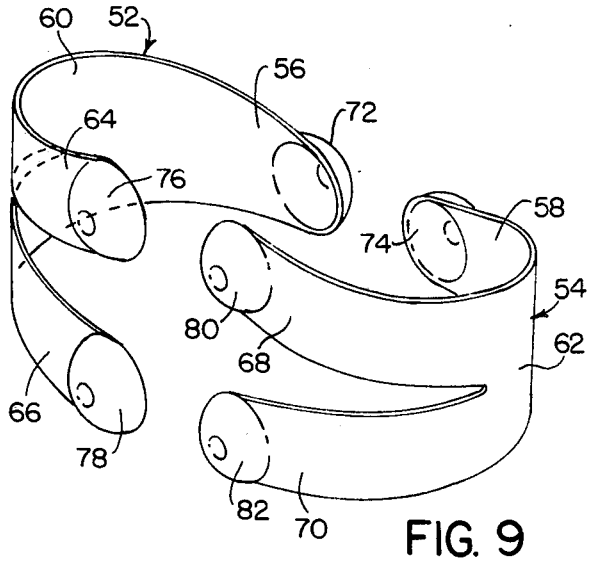
Figure 10:
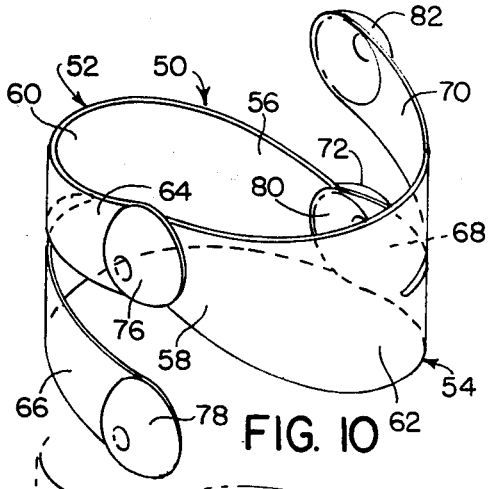
FIG. 10 is a perspective view of a reversed interengagement of the bracelet band members illustrated in FIGS. 8 and 9.

Another reversible form of the bracelet structure is illustrated in FIGS. 8, 9 and 10. The structure 50 comprises the pair of strip-form band members 52,54 having one end 56,58 respectively of relatively narrow width and tapering outwardly into a web portion or body 60,62 respectively and from that portion into split end portions 64,66 and 68,70 respectively. The narrow band end portions 56,58 are provided with protrusions 72,74 respectively, and the split end portions 64,66 with protrusions 76,78 respectively and split end portions 68,70 with protrusions 80,82 respectively.

FIG. 10 illustrates the reversible interengagement of the band members 52 and 54, in which the band member 54 is reversed for engagement of the narrow portion 58 with one of the split end portions 64, the protrusion 74 nesting in the protrusion 76 of the band member portion 64. The band member portion 68 is now inserted and the protrusion 80 nested in the protrusion 72 of the band member portion 56. The band member split end portions 70 and 66 are free of engagement with any other element and merely project from their respective web or body portions as free ends.

Figure 11:
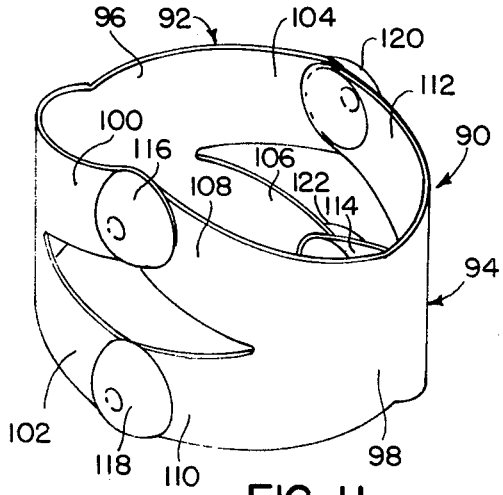
FIGS. 11 and 12 are perspective views of yet another modified form of a bracelet structure embodying the invention, showing the structure in assembled and disassembled attitudes respectively.
Figure 13:
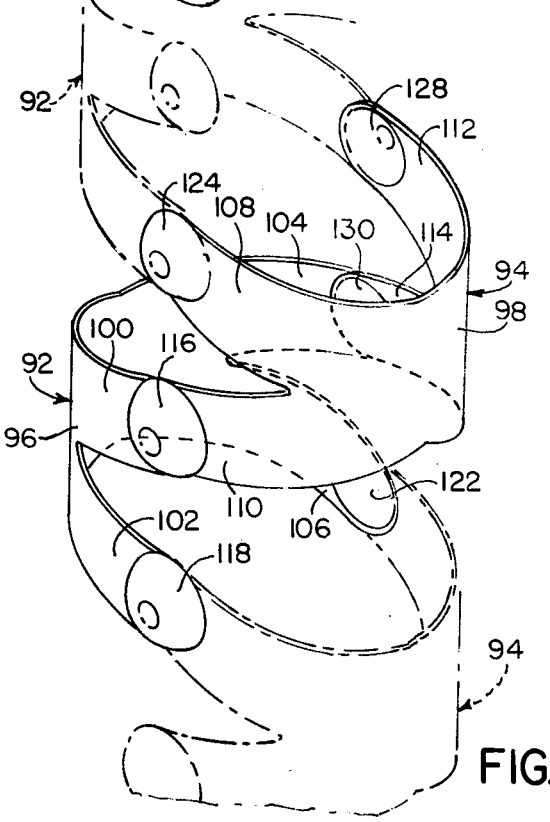
FIG. 13 is a perspective view of an alternate interengagement of the bracelet band members illustrated in FIGS. 11 and 12.
Figure 12:
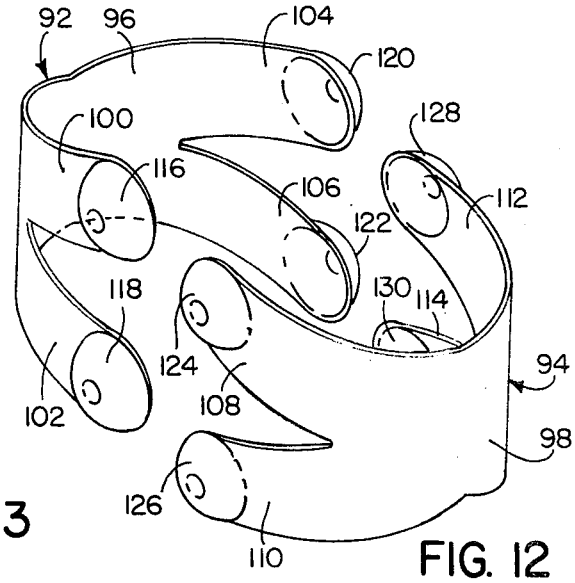

Another form of the bracelet structure invention, illustrated in FIGS. 11, 12 and 13, utilizes split end portions on both sides of the web or body of the band members. The bracelet 90 comprises the band members 92,94 having a web or body portion 96,98 respectively and split end portions 100, 102, 104 and 106 on the band member 92 and 108,110, 112 and 114 on the band member 94, the split end portions terminating in protrusions 116, 118, 120, 122, 124, 126, 128 and 130 respectively.

Engagement of the bracelet band members 92 and 94 in a conventional manner is illustrated in FIG. 11, and in an alternate or sequential manner in FIG. 13. This latter view also shows, in broken lines, how a plurality of band members similar or substantially identical to the members 92 and 94 can be interengaged in a sequential or chain or link-type relationship. In this view, FIG. 13, the band member 94 has been shifted so that the split end portions 110 and 114 have been interengaged with the split end portions 100 and 104 of the member 92, at protrusions 126 and 116, and 130 and 120 respectively. Additional band members of similar or substantially identical form can now be connected to the free end portions 108 and 112 of member 94 (above), and to the free end portions 102 and 106 (below), to form a chain or sequence of these members.

Figure 14:
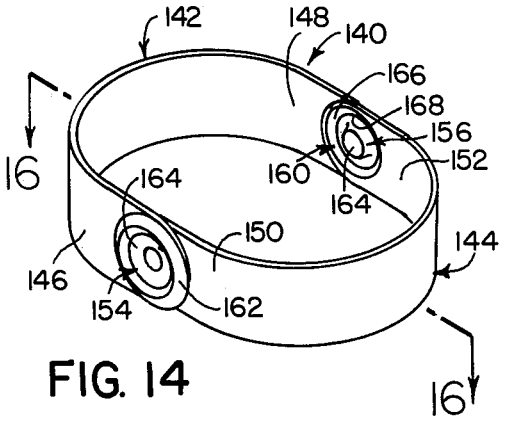
FIGS. 14 and 15 are perspective views of still another modified form of a bracelet structure embodying the invention, showing the structure in assembled and disassembled attitudes respectively.
Figure 15:
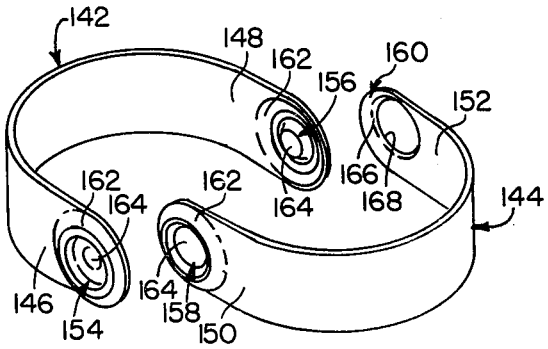
Figure 16:
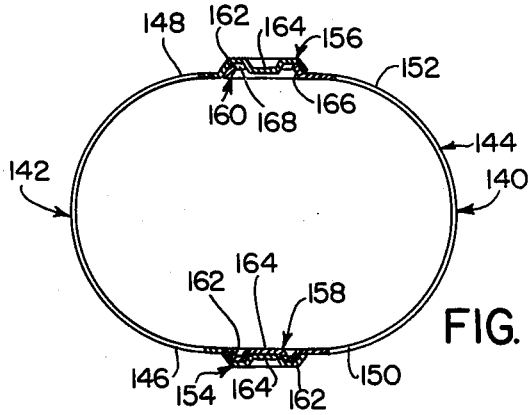
FIG. 16 is a horizontal sectional view, partially in elevation, taken substantially on the line 16—16 of FIG. 14.

The protrusions at the ends of the band members heretofore described are of the partially spherical or hemispherical form. Two modified forms of protrusions are illustrated in FIGS. 14, 15 and 16. Bracelet structure 140 comprises the band members 142, 144 terminating at their respective ends 146,148 and 150,152 in protrusions 154, 156 and 158,160 respectively.

The protrusions 154, 156 and 158 are a combination of an annular, outwardly extending, frusto-spherical ridge or collar 162 and a central concave axial depression or dimple 164. The protrusion 158 is of slightly different dimensions from the protrusions 154 and 156 in order that it complement and seat in the latter protrusions.

The protrusion 160 is an annular, outwardly extending, frusto-spherical ridge 166, a central axial opening 168 permitting the dimpled portion 164 of the protrusions 154 or 156 to pass therethrough.

Figure 17:
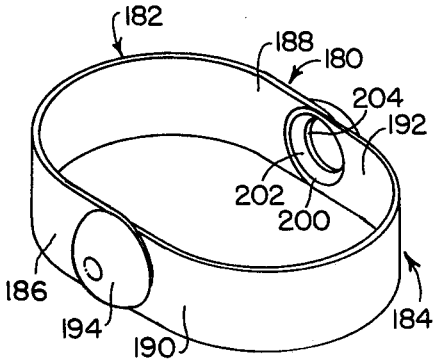
FIGS. 17 and 18 are perspective views of another modified form of a bracelet structure embodying the invention, showing the structure in assembled and disassembled attitudes respectively.
Figure 18:
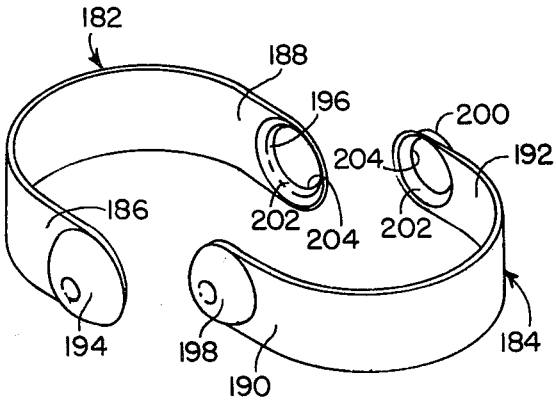

The bracelet structure 180, FIGS. 17 and 18, comprises the band members 182,184 having end portions 186 and 188, and 190 and 192 respectively, terminating in protrusions 194, 196, 198 and 200 respectively. The protrusions 194 and 198 are partially spherical in form, and the protrusions 196 and 200 are similar to the frusto-spherical protrusion 160 of bracelet structure 140 (FIGS. 14, 15 and 16). The protrusions 196 and 200 are each formed of an annular frusto-spherical, outwardly extending ridge 202 and a central axial opening 204.

Figure 19:
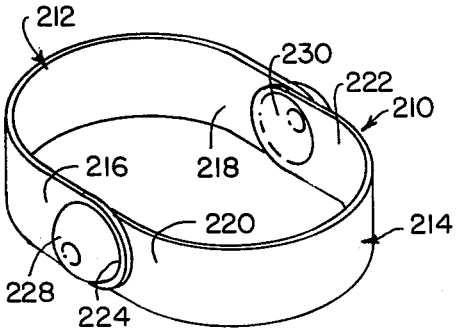
FIGS. 19 and 20 are perspective views of still another form of a bracelet structure embodying the invention, showing the structure in assembled and disassembled attitudes respectively.
Figure 20:
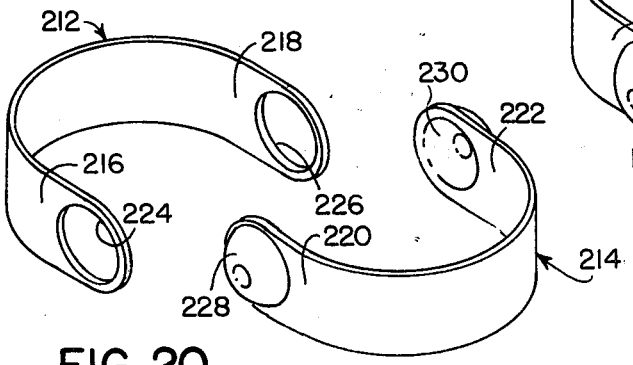

In the bracelet structure 210 illustrated in FIGS. 19 and 20, the band members 212, 214 have end portions 216,218 and 220,222 respectively. The distal ends of the end portions 216 and 218 have openings 224 and 226 respectively designed to receive and seat the protrusions 228 and 230 at the distal ends of the end portions 220 and 222 respectively of the band member 214.

The band members of the bracelet structures in each instance described and illustrated above are readily assembled by interengaging the protrusions at the ends of one member with complementary protrusions or openings at the ends of the second member, merely by flexing the distal end portions of the first member inwardly of the distal ends of the second member and allowing the protrusions of the first member to enter the concavity of the protrusions or the openings of the second member, in a complementary seating attitude. Although partially spherical protrusions have been described above, the protrusions may also be substantially conical or frusto-conical in form, without departing from the essence of the invention.

The preferred materials for these structures are metals or plastics having relatively firm physical properties of good tensile strength, relative flexibility, good to excellent maintenance of form at ambient and body temperatures, the capability of being colored, corrosion resistance, and relative economy. Both the noble and common metals can be used, plated or unplated, polished or unpolished (although the former is preferred).

Having disclosed herein certain particular embodiments of the invention for purposes of explanation, further modifications or variations thereof, after study of this specification, will or may occur or become apparent to persons skilled in the art to which the invention pertains. Reference should be had to the appended claims in determining the scope of the invention.

I claim:

1. A band or bracelet structure comprising a pair of integrally formed, unitary band members of material having good tensile strength, relative flexibility, and good to excellent maintenance of form, each said band member comprising a web or body portion intermediate one or more end portions extending longitudinally from each end thereof, each said end portion of each said band member having a fitting in the form of a laterally outwardly extending or directed convexo-concave protrusion in partially spherical or truncated spherical form, integrally formed of said end portion adjacent the distal end thereof, each said fitting on one said band member being readily interengageable with and separable from a complementary fitting on and adjacent the distal end of each said end portion of the other said band member, the fittings at the distal ends of said one band member seating within said complementary fittings at the distal ends of said end portions of the other said band member, said web or body portion including means for flexing said members to seat said fittings into and maintain them in an interengaged relation.

2. The structure defined in claim 1, wherein said band members are generally arcuate in form.

3. The structure defined in claim 1, wherein said protrusions further comprise cylindrical portions under and contiguous with said partially spherical or truncated spherical protrusions.

4. The structure defined in claim 1, wherein one or more of said fittings comprises a protrusion in the form of an annular convexo-concave frusto-spherical ridge or annular collar extending laterally outwardly from one or more said end portions.

5. The structure defined in claim 1, wherein one or more of said fittings comprises a protrusion in the form of an annular convexo-concave frusto-spherical ridge and an integrally formed central inwardly directed concave axial depression or dimple, said one or more protrusions extending laterally outwardly from one or more said end portions.

6. The structure defined in claim 1, wherein each said band member comprises a single end portion extending longitudinally from one side of said web or body portion and a pair of split end portions extending longitudinally from the other side thereof, the fittings at the distal ends of said end portions comprising said protrusions.

7. The structure defined in claim 6, wherein said band members are reversible with respect to each other, said fittings being complementary in seating engagement when said band members are reversed.

8. The structure defined in claim 1, wherein each said band member comprises a pair of split end portions extending longitudinally from each side of said web or body portion, the fittings at the distal ends of said end portions comprising said protrusions.

9. The structure defined in claim 1, wherein said band members are reversible with respect to each other, said fittings being complementary in seating engagement when said band members are reversed.

10. The structure defined in claim 1, wherein said band members are made of metal.

11. The structure defined in claim 1, wherein said band members are made of plastic materials.

12. The structure defined in claim 1, wherein one or more of said protrusion fittings comprises a protrusion in conical form.

13. The structure defined in claim 1, wherein one or more of said protrusion fittings comprises a protrusion in frusto-conical form.

14. The structure defined in claim 1, wherein said protrusions at the distal ends of one said band member are each provided with a hook adjacent thereto, and said protrusions at the distal ends of the other said band member are each provided with an opening adjacent thereto to receive said hook of said one band member, whereby a more positive interengagement of said band members is effected when said hooks are seated in said openings.

* * * * *